US005244210A

United States Patent [19]

Au

[11] Patent Number: 5,244,210

[45] Date of Patent: Sep. 14, 1993

[54] GOLF PUTTER SYSTEM

[76] Inventor: Lawrence Au, 14386 Yale, Livonia, Mich. 48154

[21] Appl. No.: 947,474

[22] Filed: Sep. 21, 1992

[51] Int. Cl.[5] ..... A63B 53/04; A63B 53/08

[52] U.S. Cl. ..... 273/164.1; 273/171; 273/173

[58] Field of Search ..... 273/167 R-77 A, 273/186.2, 187.4, 194 R, 194 A, 194 B, 164.1, 81 A, 63 E, 65 EC, 59 B, 26 B, 162 R

[56] References Cited

U.S. PATENT DOCUMENTS

| | | | |
|---|---|---|---|
| 1,167,387 | 1/1916 | Daniel | 273/81 A |
| 1,840,924 | 1/1932 | Tucker | 273/171 X |
| 2,750,194 | 6/1956 | Clark | 273/171 |
| 2,859,972 | 11/1958 | Reach | 273/164.1 |
| 3,884,477 | 5/1975 | Bianco | 273/187.4 |
| 3,909,005 | 9/1975 | Piszel | 273/171 |
| 3,979,122 | 9/1976 | Belmont | 273/171 |
| 4,291,883 | 9/1981 | Smart et al. | 273/187.4 X |
| 4,607,846 | 8/1986 | Perkins | 273/171 |
| 4,828,266 | 5/1989 | Tunstall | 273/171 |
| 4,872,684 | 10/1989 | Dippel | 273/171 X |
| 4,962,932 | 10/1990 | Anderson | 273/171 |
| 5,121,922 | 6/1992 | Harsh | 273/171 X |

FOREIGN PATENT DOCUMENTS

| | | | |
|---|---|---|---|
| 346671 | 4/1931 | United Kingdom | 273/171 |
| 1387955 | 3/1975 | United Kingdom | 273/171 |
| 1470768 | 4/1977 | United Kingdom | 273/171 |
| 2200560 | 8/1988 | United Kingdom | 273/171 |

OTHER PUBLICATIONS

"Golf Digest" Magazine, Aug. 1977 issue, p. 82.
"Golf Digest" Magazine, Apr. 1974 issue, p. 122.

*Primary Examiner*—William H. Grieb
*Assistant Examiner*—Sebastiano Passaniti
*Attorney, Agent, or Firm*—Charles W. Chandler

[57] ABSTRACT

A golf club head, particularly a putter, having an improved selectable weight and adjustable balance system. The head has an elongated threaded weight chamber extending from toe to heel. The chamber contains weights, preferably coins, and thrust/ friction washers which are captured and secured by opposing threaded end plugs. The amount of weights used and their collective effective center of gravity is adjustable by the user. The center of gravity or sweet spot is adjusted when the end plugs along with the captive weights and washers are rotated toward the toe or heel. When rotated toward each other, the end plugs produce a strong locking force on the entire weight assembly. The balance and sweet spot characteristics are also controlled by the strategic placement of weights within the chamber. The washers can also be used as spacers to aid weight distribution. When more weight separation is required, an optional compression spring is used between weights. By selecting the amount of weights deployed and by the strategic placement of the weights, many options of putter head weight and balance are available to the golfer.

12 Claims, 5 Drawing Sheets

GOLF PUTTER SYSTEM

BACKGROUND OF THE INVENTION

This invention relates to golf clubs, particularly to golf putters with a high capacity selectable weight and an adjustable balance system.

The proliferation of golf putters in the market suggests that an all purpose putter suitable for most golfers is still being sought. Putter designs such as blade, mallet, cylindrical, perimeter weighted, plastic faced, spherical head, and adjustable weight, fueled the search for a better putter. Individual characteristics of height, weight, build, putting stroke, stance, gender, left handed or right handed, along with grass conditions, and moisture content, enter into the putter selection equation.

Furthermore, many advanced and professional golfers possess numerous putters in their collection. This suggests that individual requirements change from time to time, influenced in part by experience, age and physical abilities.

The prior art discloses a variety of methods for adjusting the club weight and balance or sweet spot of a golf putter. These include putter heads having an internal bore disposed along the longitudinal axis of the putter head. For example, U.S. Pat. No. 4,963,932, issued Oct. 16, 1990 to Thomas G. Anderson, discloses a putter head having a threaded bore. The user adjusts the horizontal center of gravity by inserting weighted bolts in the heel and the toe ends of the bore. He then replaces the bolts at either end with either lighter or heavier bolts.

U.S. Pat. No. 3,979,123, issued Sept. 7, 1976 to Peter A. Belmonst, discloses a golf iron having a substantially continuous, threaded bore from the toe to the heel of the club head. Plugs of selected weights are threadably mounted in the bore. The weight and location of the plugs determines the club's weight distribution.

U.S. Pat. No. 4,828,266, issued May 9, 1989 to Timothy F. Tunstall, discloses a club head having bored ends. A threaded cylinder in the heel and toe of the head, receives and supports swing heights.

U.S. Pat. No. 4,607,846, issued to Sonnie J. Perkins, Aug. 26, 1986, U.S. Pat. No. 3,909,005, issued Sept. 30, 1975 to Geza A. Piszel; U.S. Pat. No. 3,979,123, issued Sept. 7, 1976 to Peter A. Belmont; and U.S. Pat. No. 4,9872,684 issued Oct. 10, 1989, to Stephanie A. Dippel, disclose variations of this concept.

The Dippel and Tunstall reference offer only limited weight selection. The weights are custom-made to proprietary specifications and are not readily available. In practical use on the golf course, these weights can be easily misplaced or lost by the user, not to mention the inconvenience and cost of replacement. Furthermore, once a certain weight combination is chosen to satisfy the club weight requirement, shifting the center of gravity of these weights to satisfy dynamic balance, is limited or impossible. Some weights are restricted to or fixed to a location at each end.

in the Perkins and Belmost prior art, U.S. Pat. No. 4,607,846 and U.S. Pat. No. 3,979,123, threaded weight members are featured. Weights are forcefully rotated into the housing, plugged and sealed with sealant or are left unsecured. Weight adjustment is complex, and is not practical to use on a golf course. The threaded weights must be long in order that a sufficient number of full threads prevent cross-threading and/or tilting of the threaded weights. Dime-thin weight increments for a fine weight selection is not possible in these designs.

In yet other known prior art, the adjustable weight capacity lacks sufficient mass to effectively influence the dynamic balance of the putter during the putting stroke. Other prior art includes weights that are loose. These designs produce noise. The weights within the putter head feel loose.

SUMMARY OF THE INVENTION

The broad purpose of the present invention is to provide a putter system having a wide range of swing weight selectability, and sweet spot adjustments. The preferred putter can duplicate many of the weight characteristics of the most popular commercial putter designs, while offering extensive personal putter weight selection, weight distribution and sweet spot placements.

One object of this invention is to design a simple adjustable golf putter with a high capacity, selective weight system to accommodate a broad range of putter weight options.

Another object is to provide a weight system whereby the selected weights can be precisely and strategically placed along the full length of the putter head from toe to heel, for adjusting the sweet spot or center of gravity. The user has optimum control over the swing weight selection, the sweet spot placement as well as the balance characteristics of this or her putter.

The invention allows the user to simulate the weight and dynamic balance of many popular putter designs on the current market. It also allows the user to easily change the major static and dynamic weight characteristics of his putter without additional perches or changing to another putter. The user can experiment with and fine-tune the weight, balance and sweet spot locations to improve his or her putting stroke and accuracy.

The deployment of weights can be concentrated in a single area behind the the putter face, distributed evenly or in any configuration along the entire length of the weight chamber, from toe to heel of the putter head. Lightweight spacers can be inserted in any order to accomplish the weight spread. Two or more weight groups can also be deployed for the strategic placement of weight concentrations, i.e. in the popular toe and heel weight location. A compression spring and/or spacers can be inserted between weights if greater weight spread is desired.

The user can manipulate the weight placement to adjust the balance of the putter was well as the location and spread of the putter sweet spot to his or her liking. Balance adjustments can also be accomplished by rotation of the end threaded plugs.

The use of United States coins as selectable weight elements in this putter invention offers excellent availability, size consistency, weight consistency, non-corrosiveness, thin increments for large numerical selection, interchange-ability and low cost. The high capacity full length toe to heel weight chamber accommodates up to several dozer coins for deployment as weight elements for putter weight selection and placement. By the addition or removal of weight elements a wide range of over all putter weights can be selected by the user.

The large weight accommodation capacity of this invention make possible to use of light-weight, modern high tech material for the construction of the putter head. The high capacity adjustable weight system can offset the lower mass density of many selected head compositions. Materials such as titanium, graphite, aluminum, arylic, nylon, acetal and other low density materials can be used to take advantage of their superior impact characteristics for better putter designs.

Traditional putter construction materials, including copper and iron composites, can also be used effectively with this variable weight putter invention. The variable weight system can be adjusted to maintain the traditional size and shape of the putter design, independent of the material density used in the putter head construction. The weight system compensates for the difference in the head material density. The weights in the adjustable weight system can be added or removed to compensate for the lighter or heavier head material used.

An observation port, incorporated in the rear of the putter head, provides means for monitoring of weight arrangement in the weight chamber. The amount and location of the weights can easily be observed.

A putter visual alignment decal is adhered to the top of the putter head along the front edge of the putter face. Alignment markings, scale and manufacturer identification can be imprinted on the decal.

A second decal to identify the sweet spot location is placed over a portion of the larger alignment decal. The sweet spot decal features semi-permanent adhesive for subsequent sweet spot relocation. Color coding is imprinted on the sweet spot decal to accentuate its location.

To maintain simplicity, this invention uses a coin as the tool for removing or adjusting the end plug in the putter head. The end plugs have slots for mating either with a coin or a screw driver.

The preferred putter head has a plastic tubular configuration. A longitudinal threaded bore extends from the heel to the toe of the putter head. A pair of threaded plugs are mounted in the bore. A selected number of coins, such as pennies, nickels, dimes and quarters, are disposed between the plugs. The plugs clamp a resilient, compression spacer with the coins to prevent coin rattle. A compression spring is provided when more separation is required between weights. The spring also provides retention force on the coin weights in this option.

The location of the plugs, coins, springs and spacers defines the weight distribution of the head, and the location of the "sweet spot". Multiple spacers can be strategically deployed to accommodate the desired weight distribution. The amount of weights deployed determines the putter total weight.

Another embodiment of the invention employs a second set of plugs, coins and spacer. The two sets of weights are mounted at opposite ends of the putter head, at the toe and at the heel. Each set is independently adjustable.

For certain weight placement such as the popular heel and toe weight concentration, an additional embodiment of the invention employs a coil, water or other form of compression spring between the weight groups. The spring applies containment force and takes upon or provides more space as dictated by the amount or space displacement required by the coin weights deployed at each end of the spring. Multiple springs may be deployed to separate multiple weight groups. Resilient spacers may also be added if required to adjust spring force and control weight placement.

Many combinations of weight placement can be generated by the selective use of threaded plugs, coin weights, resilient spacers and compression springs is a common housing bore. The static and dynamic weight characteristics of many popular putters can be simulated without the expense of purchasing many putters to evaluated the putting characteristics of each.

It is also a goal of this invention to retain simplicity and promote modern technologies and innovations.

Still further objects and advantages of the invention will become apparent to those skilled in the art to which the invention pertains upon reference to the following detailed description.

THE DRAWINGS

The description refers to the accompanying drawings in which lie reference characters refer to like parts of the several views, and in which.

DESCRIPTION OF THE PREFERRED EMBODIMENTS

Figure 1:
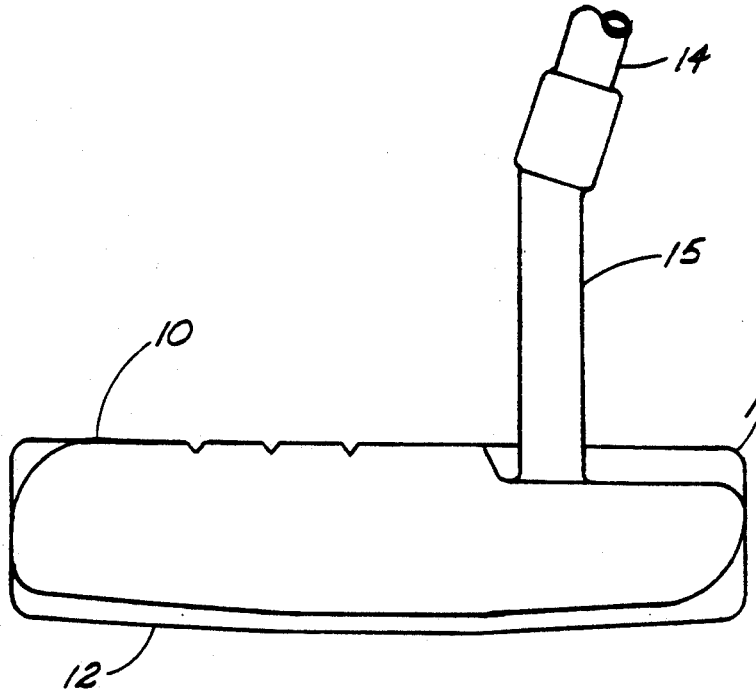
FIG. 1 is a view of a putter head with integral hose illustrating the preferred embodiment of the invention with the shaft cut off.
Figure 3:
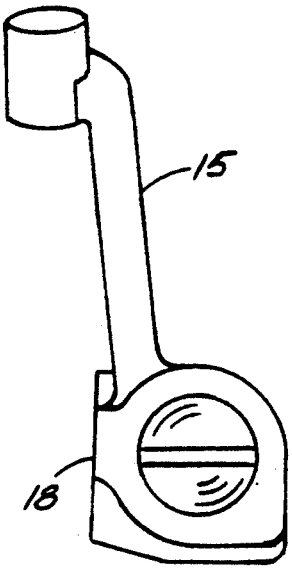
FIG. 3 is a view of the heel end of the putter head with end plug.

Referring to the drawings, FIGS. 1 to 4 illustrate a preferred metal golf putter head 10 having an elongated tubular weight housing 12. A metal shaft 14 is connected to the hose or neck 15 on the putter head at an appropriate positions, preferably near heel end 16 of the housing. The head has a striking surface 18 along the front the front side of the club. The head has an internally threaded bore 20 that extends the full length of the head, parallel to and preferably behind striking surface 18. One end of the bore opens at toe 22, the opposite end at heel 16.

Figure 2:
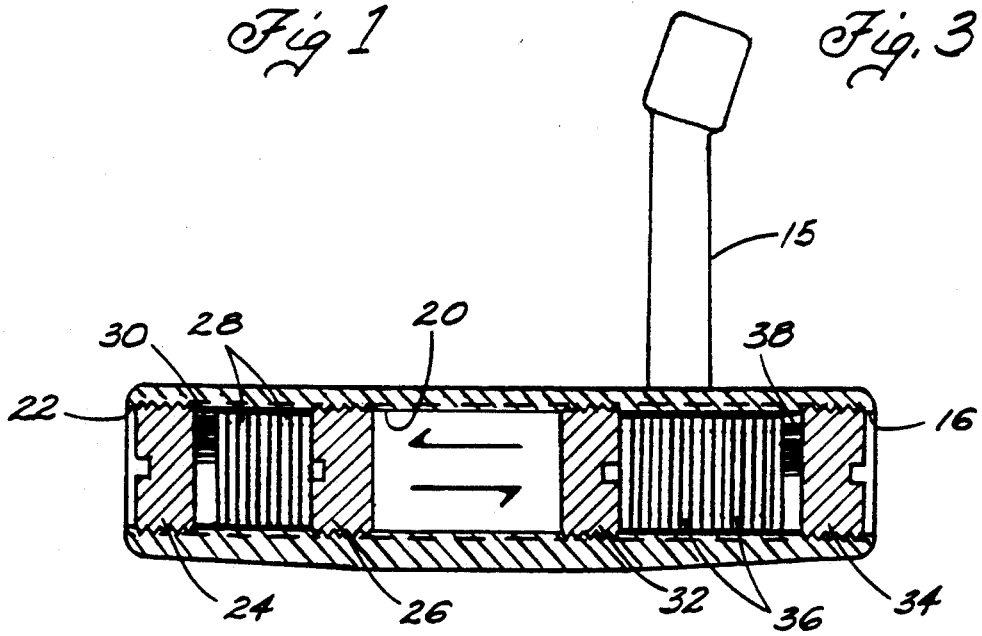
FIG. 2 is a longitudinal sectional view of the preferred putter head.

A pair of metal or plastic plugs 24 and 26 are mounted adjacent the toe of the housing, as best viewed in FIG. 2. A typical plug 24 has a slot 25 permitting the user to insert a coin or screw driver for either removing, inserting, or repositioning the plug. The other plugs have a similar slot. An optional hex head receptacle can also be used.

A selected number of disk-shaped weights 28 are disposed between plugs 24 and 26. Preferably, the weights comprises coins, such as pennies, having a diameter slightly less than that of the bore. The coins are relatively freely movable in the bore when they are not being clamped between the two plugs. A compression disc 30 of a suitable compression material, is mounted adjacent plug 22. The compression disc prevents the coins from rattling when they are clamped between the plugs. The compression disc can be located in any position amongst the coins and between the plugs.

The coins may comprise tokens, nickels, dimes, quarters or foreign coins.

The plugs and coins can be moved to a selected position along the length of the bore to establish the sweet spot. Inserting or removing one or more coins adjusts the overall weight of the head.

A second pair of threaded plugs is mounted adjacent the heel end of the bore. Plugs 32 and 34 are identical to plugs 24 and 26. Plugs 32 and 34 clamp a another group of weights, preferably coins 36. A friction compression disc 38 is mounted between the coins and the plugs to prevent the clamped coins from rattling. Both weight groups can be adjusted individually as to weight amount and location.

Figure 7:
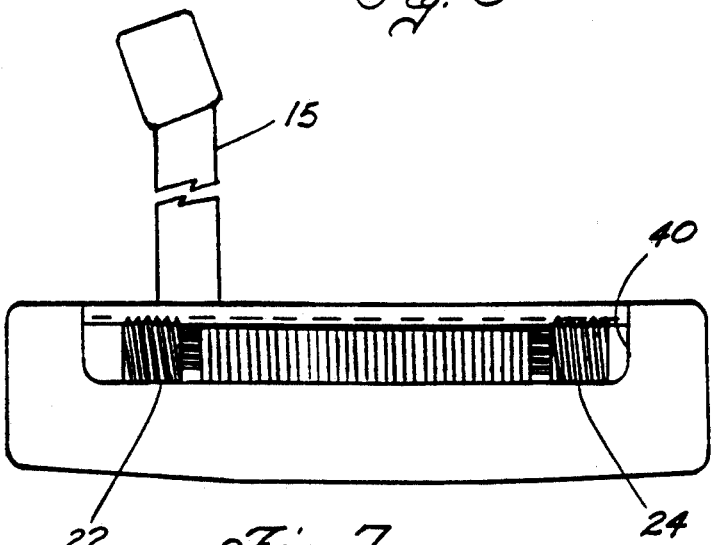
FIG. 7 is a rear view of the preferred putter with the weight assembly centrally located.
Figure 8:
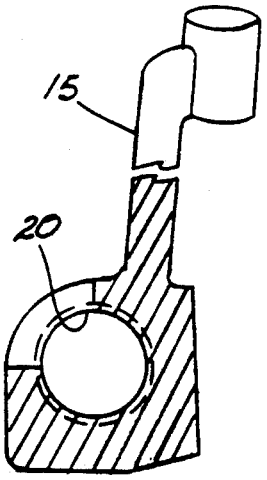
FIG. 8 is a sectional view looking from the toe end of the putter head through the longitudinal opening.

FIG. 7 illustrates the back side of the putter head. The weight housing has an elongated port 40. The ends of the port terminate short of the heel and toe of the head. The port provides means for observing the location of the contents of the bore, that is, the plugs, coins and spacers. The port assists the golfer in weight distribution i.e., relocating the sweet spot and/or adjusting the overall head weight.

Coins, other than pennies, can be employed. A single set of coins and plugs may be employed, extending a substantial length of the bore, as shown in FIG. 7. The weight distribution of a set of coins may be expanded by inserting additional compression spacers between the individual coins in any combinations or mix, as illustrated in FIG. 6.

The preferred weight system provides means for achieving precise swing weight selection and weight distribution to satisfy individual feel and putting requirements. The weight distribution can be conveniently expanded, concentrated or relocated. The amount of weights can be added or removed incrementally to select the overall putter weight desired.

Figure 6:
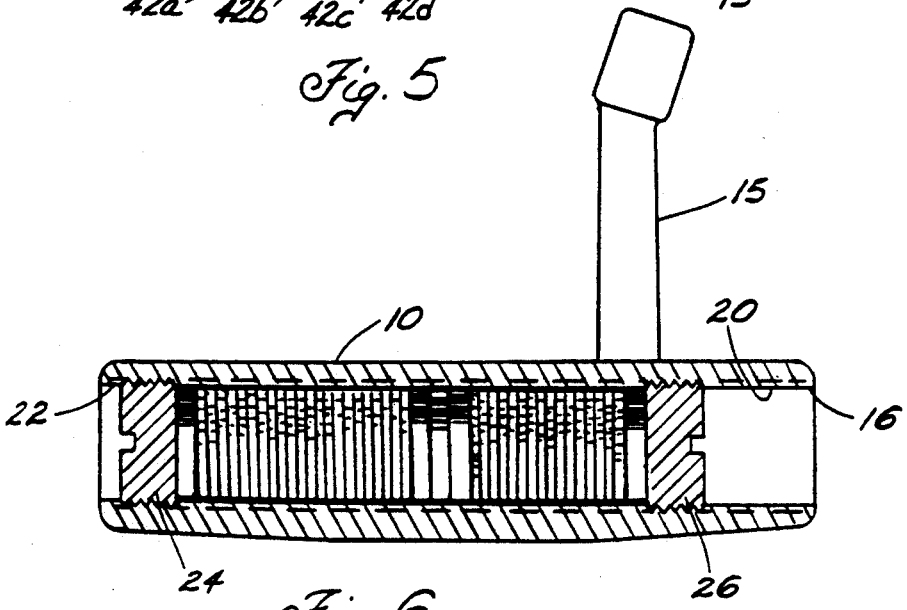
FIG. 6 is a view similar to FIG. 2, but showing one continuous set of spaces and weights.

FIG. 7 illustrates an arrangement where the resilient disks are located adjacent the threaded plugs, whereas FIG. 6 shows not only a resilient disk adjacent the end plugs, but, three of them are located to separate the coins into two concentrations to establish the overall balance of the putter.

Figure 4:
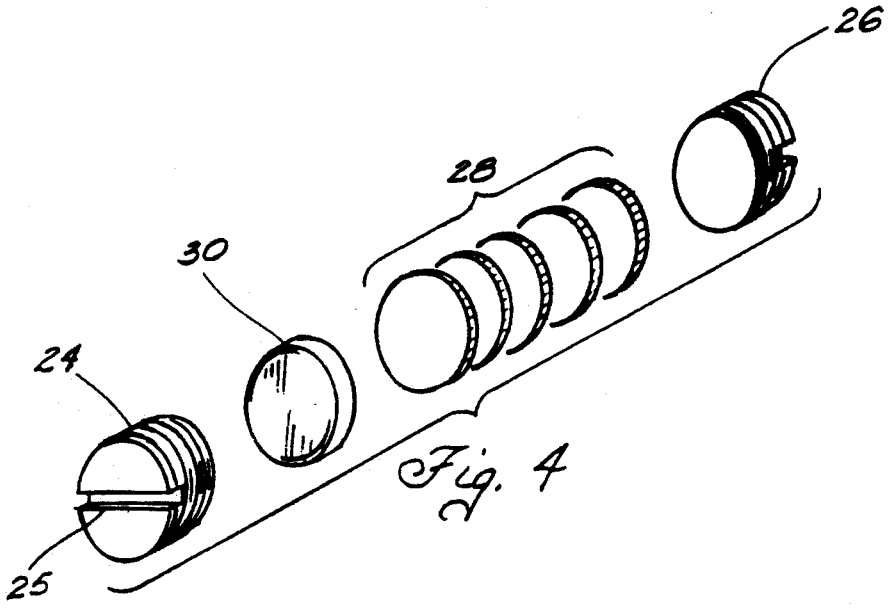
FIG. 4 is an exploded view of a set of weights with spacer and end plugs.
Figure 4A:
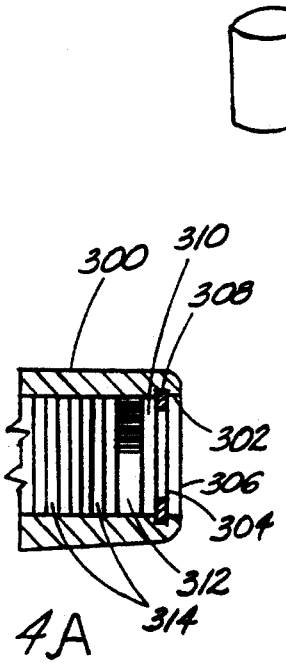
FIG. 4A and 4B are views showing a snap ring as an alternative structure for retaining the coins in place.
Figure 4B:
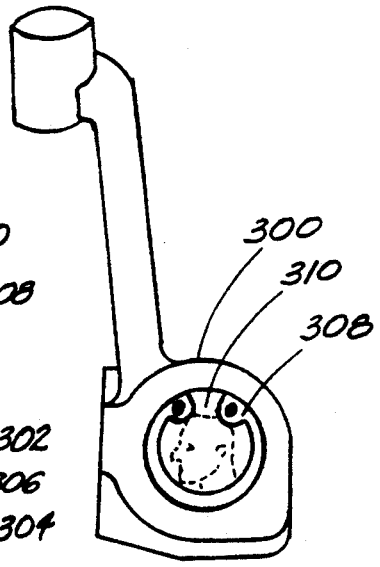

FIGS. 4A and 4B illustrate another embodiment of the invention in which putter head 300 has a through bore 302. An annular slot 304 adjacent the heel end opening 306 receives a snap ring 308. The snap ring is employed for retaining coin 310, a compression spacer 312, and a plurality of conis 314, all on the inside of the bore to contain the putter adjustable weight system. The snap ring may be used at one or both the toe and heel ends.

The threaded plugs are illustrated as having a screw slot on one face of the plug, however, an optional design could have the screw slot on both faces of the plug to improve access.

Figure 5:
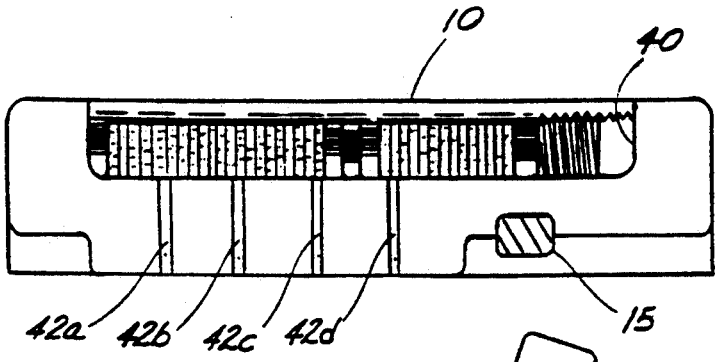
FIG. 5 is a plan view of the putter head of FIG. 1.

FIG. 5 illustrates alignment grooves 42*a*, 42*b*, 42*c* and 42*d* which are integral part of the putter head casting.

The use of light-weight head material is feasible by deploying more coin weights in the weight housing to compensate for the reduced weight of the body material.

Figure 9:
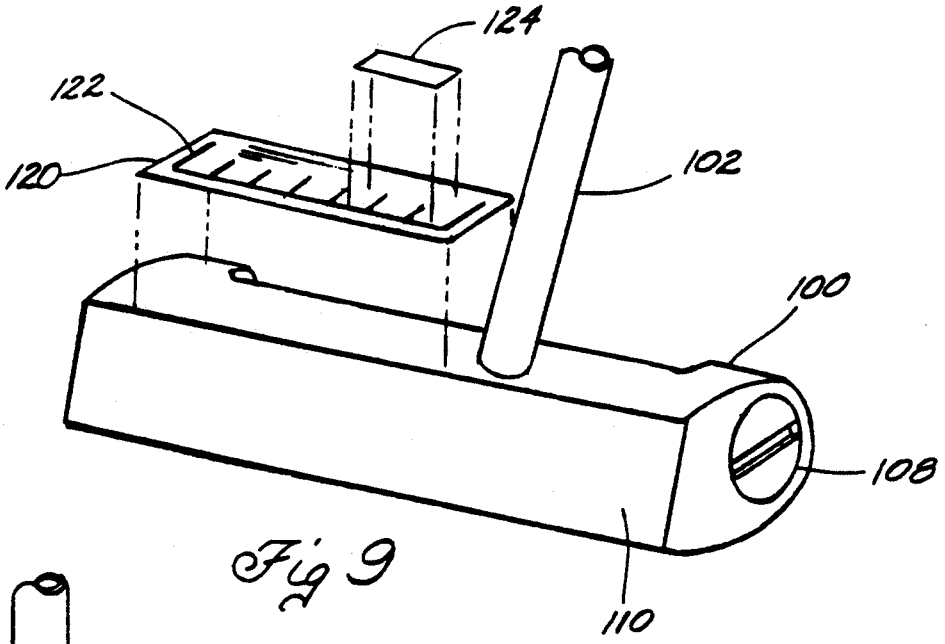
FIG. 9 is a putter head with a decal assembly, shown in an exploded relationship.
Figure 10:
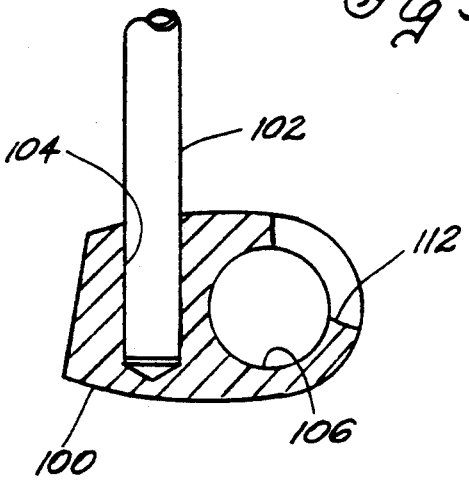
FIG. 10 is a sectional view showing another putter head design with putter shaft illustrating the invention.
Figure 11:
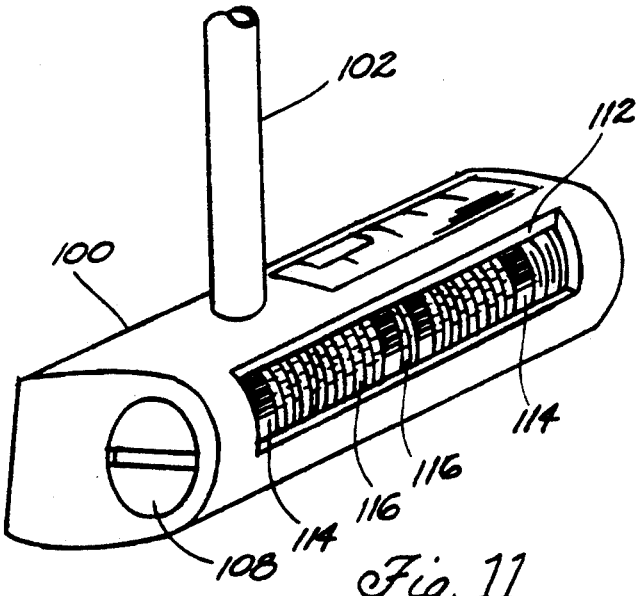
FIG. 11 is a perspective view of a preferred putter head.

FIGS. 9 and 11 illustrate another embodiment of the invention. An elongated head 100 formed of an injection molded plastic, has the main basic configuration as the embodiment of FIG. 1, including a shaft 102 which may be formed of metal graphite or other suitable composite material. Shaft 102 is received in an opening 104 in the top of head 100. The head has a longitudinal bore 106. The bore is threaded throughout its length for receiving threaded end plugs 108, only one shown. The front face 110 of the head forms a striking surface. The rear face has an elongated, rectangular port 112 for viewing the resilient spacer means 114 and coins 116, clamped between the end plugs.

Referring to FIG. 9, a visual alignment decal 120 is adhesively attached to the top of the putter head. Decal 120 has a series of indicia or alignment marks 122 spaced along the longest of the putter body to provide alignment markings. The decal can also provide scale and manufacturer identification information.

A second decal 124 is mounted on top of decal 120. Decal 124 identifies the sweet spot location and employs a semipermanent adhesive for subsequent sweet spot relocation. Decal 124 may be color-coded to accentuate the sweet spot decal placement.

Figure 12:
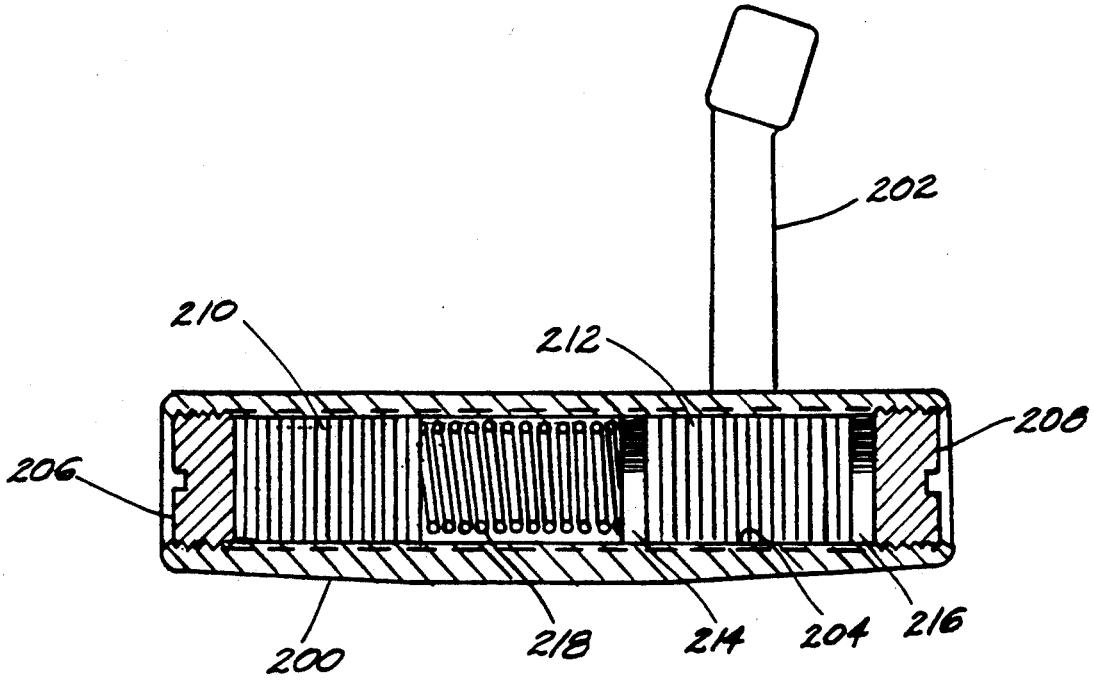
FIG. 12 is a section view showing a compression spring between weight groups.

FIG. 12 illustrates a compression spring deployed between heel and toe weight groups. Discs 30 are also deployed.

A head 200 formed of injection-molded plastic or metal casting, has basic configuration as the embodiment of FIG. 1, including the hosel 202 which is integral part of the head. The head has a longitudinal bore 204 which is threaded its full length. End plugs 206 and 208 are mounted at the opposite open ends of bore 204. The two groups of weights 210 and 212 each preferably formed of a series of coins, are mounted in the bore between the end plugs. A pair of compression disc 214 and 216, which are identical to friction compression discs 30 and 38, are mounted on opposite sides of a group of weights 212. Compression disc 216 is in contact with the endmost coin of group 212 adjacent end plug 208.

A compression spring 218 is mounted between the group of coins 210 and compression disc 214. Spring 218 biases the weights 210 toward end plug 206 and weights 212 toward end plug 208. Compression spring 218 may be a coil spring, wafer spring, or other compressions type spring. The spring may be deployed in multiple units. The function of the spring is to readily accommodate the distance between the two groups of weights as well as to accommodate increased or reduced numbers of coins in the groups of weights. It functions as a variable spacer between the two groups of weights to readily assist in establishing the sweet spot. The spring also exerts retaining force on the coins, spacers and plugs.

The sweet spot or center of gravity of the putter head may be adjusted by shifting one or more weight groups and by the strategic placement and distribution of the weights within the weight chamber sided by using multiple spacers or springs along with plug adjustments. The observation port aids in the location and placement of the weights.

The total weight of the putter is controlled by selecting the precise number of weights placed in the weight housing bore. Thus a comprehensive putter weight control system with many weight options and balance adjustments is available to the user in a single putter assembly.

Having described my invention, I claim:

1. A golf putter, comprising:

an elongated, generally tubular head having a striking surface, a toe end and a heel end;

a shaft fixed to the head;

the head having an elongated bore connecting the heel end to the toe end, the bore being substantially, continuously threaded from the heel end to the toe end;

a first pair of threaded plugs, each of said plugs being threadably movable along substantially the full length of the threaded bore;

a selected number of similarly-shaped, discshaped weights disposed between the first pair of threaded plugs;

a compressible spacer disposed between the pair of plugs to prevent relative motion between the weights, plugs and the head;

whereby the first pair of plugs, spacer and weights may be moved to a selected position along the length of the bore in the head to adjust the location and balance of the putter's sweet spot.

2. A golf putter as defined in claim 1, including:

a second pair of threaded plugs disposed in the threaded bore and a selected number of similarly-shaped, disc-shaped weights disposed between the second pair of threaded plugs;

a compressible spacer disposed between the second pair of plugs to prevent relative motion between the weights and the head, whereby the first pair of plugs and associated weights may be disposed adjacent one end of the head, and the second pair of plugs and associated weights may be disposed adjacent the opposite end of the head to balance the putter head and establish the sweet spot location and the sweet spot spread of the putter head.

3. A golf putter as defined in claim 1, in which the weights comprise a plurality of coins, tokens or circular disks.

4. A golf putter as defined in claim 1, in which the weights comprise a group of pennies, nickels, dimes, quarters or foreign coins.

5. A golf putter as defined in claim 1, in which the body has observation port means disposed along the length of the head, the port means opening into the threaded bore so that the user can observe the location and placement of the plugs, spacers, springs and weights in the weight housing.

6. A golf putter as defined in claim 1, in which the head is formed of a plastic material.

7. A golf putter as defined in claim 1, in which the first pair of plugs may be inserted from either the toe and or the heel end of the bore, or from both the toe and heel ends.

8. A golf putter as defined in claim 1, in which the weights are disposed in a pair of spaced groups between the threaded plugs, and including a compression spring disposed between the spaced groups of weights to bias the group toward the plugs.

9. A golf putter as defined in claim 1, including a plurality of spacers disposed in any configuration and combination between the weights to effect weight distribution and establish sweet spot placement as well as the sweet spot size or spread.

10. A golf putter as defined in claim 1, in which snap rings are used at the toe and the heel ends of the weight housing bore to retain the weights and the spacer in the housing bore.

11. A golf putter as defined in claim 1, in which a nonpermanent decal is used to indicate the location of the sweet spot established by the user.

12. A golf putter, comprising:

an elongated, generally tubular head having a striking surface, a toe end and a heel end;

a shaft fixed to the head;

the head having an elongated bore connecting the heel end to the toe end;

a pair of compression discs in said bore;

a pair of snap rings mounted at opposite ends of the bore;

a selected number of similarly-shaped, disc-shaped weights disposed in spaced weight groups between the snap rings; and a compression spring being disposed to separate the weight groups and to prevent relative motion between the weights, snap rings, and the head.

* * * * *

UNITED STATES PATENT AND TRADEMARK OFFICE

CERTIFICATE OF CORRECTION

PATENT NO. : 5,244,210

DATED : September 14, 1993

INVENTOR(S) : Lawrence Au

It is certified that error appears in the above-identified patent and that said Letters Patent is hereby corrected as shown below:

Column 1, line 43, change "heights" to --- weights ---.

Column 2, line 35, change "perches" to --- purchases ---.

Column 2, change "dozer" to --- dozen ---.

Column 2, line 66, change "to" to --- the ---.

Column 3, line 3, change "arylic" to --- acrylic ---.

Column 3, line 58, change "water" to --- wafer ---.

Column 3, line 61, change "upon" to --- up ---.

Column 4, line 1, change "is" to --- in ---.

Column 4, line 15, change "lie" to --- like ---.

Column 4, line 17, change "hose" to --- hosel ---.

Column 4, line 30, change "spaces" to --- spacers ---.

UNITED STATES PATENT AND TRADEMARK OFFICE

CERTIFICATE OF CORRECTION

PATENT NO. : 5,244,210

DATED : September 14, 1993

INVENTOR(S) : Lawrence Au

It is certified that error appears in the above-identified patent and that said Letters Patent is hereby corrected as shown below:

Column 4, line 49, change "hose" to --- hosel ---.

Column 6, line 17, to --- length ---.

Column 6, line 59, change "sided" to --- aided ---.

In Claim 1, column 7, line 13, change "discshaped" to --- disc-shaped ---.

Signed and Sealed this

Third Day of May, 1994

Bruce Lehman

*Attest:*

BRUCE LEHMAN

*Attesting Officer*

*Commissioner of Patents and Trademarks*